US006125809A

United States Patent [19]

Boast

[11] Patent Number: 6,125,809

[45] Date of Patent: Oct. 3, 2000

[54] VALVE REDESIGN FOR IMPROVED LIFE

[75] Inventor: Saul T. Boast, Metamora, Ill.

[73] Assignee: Caterpillar Inc., Peoria, Ill.

[21] Appl. No.: 09/176,078

[22] Filed: Oct. 20, 1998

[51] Int. Cl.[7] ..... F02N 3/00

[52] U.S. Cl. ..... 123/188.3

[58] Field of Search ..... 123/188.3, 188.11, 123/188.12

[56] References Cited

U.S. PATENT DOCUMENTS

| | | | |
|---|---|---|---|
| 1,583,432 | 5/1926 | Wilcox . | |
| 1,823,452 | 9/1931 | Heron | 123/188.3 |
| 1,889,916 | 12/1932 | Colwell . | |
| 2,029,507 | 2/1936 | Scrimgeour | 123/188.3 |
| 2,062,641 | 12/1936 | Clouse | 10/86 |
| 2,135,966 | 11/1938 | Daisley | 123/188 |
| 2,316,488 | 4/1943 | Roth | 123/188 |
| 2,682,261 | 6/1954 | Achor | 123/188 |
| 3,040,417 | 6/1962 | Newton | 123/188.3 |
| 3,503,375 | 3/1970 | Thompson | 123/188 |
| 3,919,984 | 11/1975 | Yagi et al. | 123/260 |
| 3,978,830 | 9/1976 | Toth, Jr. | 123/90.67 |
| 4,169,488 | 10/1979 | Goloff et al. | 137/340 |
| 4,433,652 | 2/1984 | Holtzberg et al. | 123/188 AA |
| 4,685,653 | 8/1987 | Kaltenthaler et al. . | |
| 4,882,829 | 11/1989 | Dawe | 29/251 |
| 5,076,866 | 12/1991 | Koike et al. | 148/437 |
| 5,081,965 | 1/1992 | Walters et al. | 123/188.3 |
| 5,460,139 | 10/1995 | Marlin et al. | 123/188.3 |
| 5,592,913 | 1/1997 | Matthews | 123/188.3 |
| 5,771,852 | 6/1998 | Heimann, Jr. et al. | 123/188.3 |

FOREIGN PATENT DOCUMENTS

| | | |
|---|---|---|
| 1017784 | 1/1964 | United Kingdom . |

*Primary Examiner*—Weilun Lo
*Assistant Examiner*—Jason Benton
*Attorney, Agent, or Firm*—Fred J. Baehr

[57] ABSTRACT

A valve for an internal combustion engine comprising a head with a seat ring and a stem that slidably fits in a valve guide, the stem having a necked down portion disposed between the head and the valve guide, the necked down portion being generally hour glass shaped and having a diameter that is reduced generally about 75 to 84 percent of the diameter of the portion of the stem that fits in the valve guide to reduce stresses on the head and improve proper seating of the valve to extend it life.

3 Claims, 1 Drawing Sheet

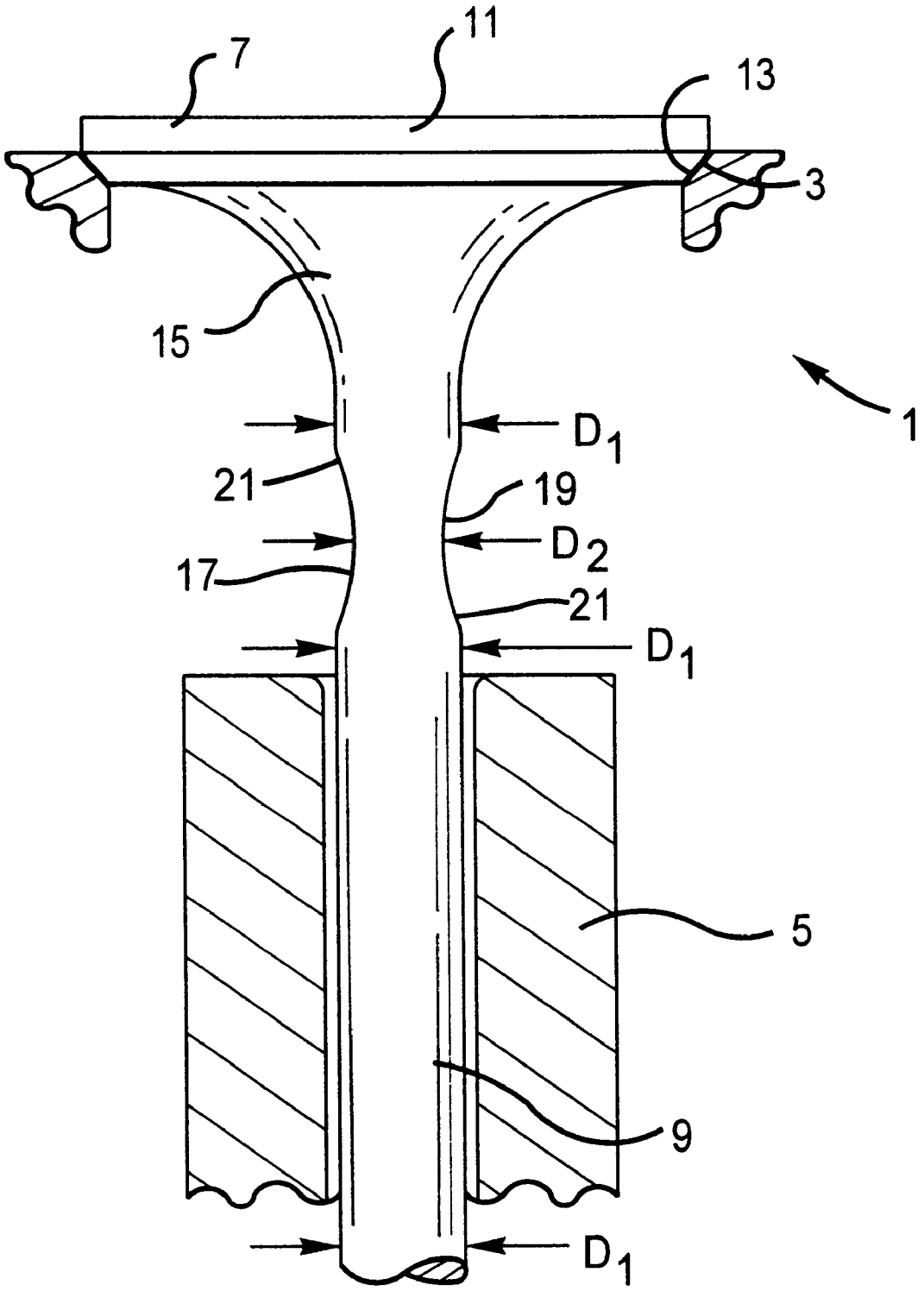
11
7
13
3
15
1
D1
21
19
D2
17
21
D1
5
9
D1

VALVE REDESIGN FOR IMPROVED LIFE

TECHNICAL FIELD

The invention relates to a valve for an internal combustion engine and more particularly to a valve redesigned for improved life.

BACKGROUND ART

Engine cylinder heads distort sufficiently under operating thermal and mechanical loads to misalign the valve seat—valve guide relationship. This misalignment causes either very high mechanical stress in the valve head when it is seated and/or prevents the valve from seating completely. Improper seating may cause flash heating or cooling due to exhaust gases or intake air rushing through small gaps between the valve and seat resulting in uneven heating or cooling of the head thus thermally stressing the head of the valve. U.S. Pat. No. 5,592,913 describes an exhaust valve with a tapered stem portion that has a head portion with a frustoconical seat. A trumpet like portion that extends from the seat portion to a tapered portion, which tapers outwardly to a cylindrical portion that is slidably disposed in a valve guide. A weld joins the tapered portion to the cylindrical portion. This juncture is always disposed in the valve guide to prevent scuffing and seizure at the inlet of the valve guide due to differential thermal expansion as the head and stem portions are formed of different alloys.

DISCLOSURE OF THE INVENTION

Among the objects of this invention may be noted the provision of a valve that will seat properly, hermetically and have a longer life.

In general, a valve for an internal combustion having a head with a valve guide and a valve seat aligned, when made in accordance with this invention, the valve comprises a head portion with a seat ring that seats in the valve seat in the head of the engine. A generally trumpet shaped portion which curves inwardly from the seat ring to a stem portion having a diameter that slidably fits in the valve guide. A portion of the stem between the valve guide and the trumpet shaped portion of the head is necked down to a diameter generally between 75 to 84 percent of the diameter of the stem portion that slidably fits in the valve guide. The spring constant of the necked down portion of the stem is thereby reduced sufficiently to allow the valve stem to bend to accommodate misalignment of the valve guide and valve seat in the head of the engine due to thermal and mechanical loads resulting from operation of the engine. The bending of the stem allows the valve to seat properly reducing stress in the valve head portion and not over stressing the necked down portion of the stem to prolong the life of the valve.

BRIEF DESCRIPTION OF THE DRAWINGS

The invention as set forth in the claims will become more apparent by reading the following detailed description in conjunction with the accompanying drawing in which:

The Sole FIGURE is a partial sectional view of a valve in a head of an engine.

BEST MODE FOR CARRYING OUT THE INVENTION

Referring now to the Sole FIGURE in detail, there is shown a portion of a head of an internal combustion engine 1 having a valve seat 3 aligned with a valve guide 5. A valve

7 has a stem portion 9 having a diameter D1, which slidably fits within the valve guide 5. Attached to the stem portion 9 is a head portion 11 with a frustoconical seat ring 13 that is shown seated in the valve seat 3 in the head of the internal combustion engine 1. The head portion 11 of the valve 7 has a trumpet shaped portion 15 that curves inwardly from the frustoconical seat ring 13 to the stem portion 9 having a diameter of D1 that slidably fits the bore of the valve guide 5. The stem 9 has a necked down portion 17, which is generally hour glass shaped with an arcuate concave center potion 19 and a arcuate convex portion 21 on each end of the concave arcuate center portion 19 forming a smooth transition from the concave center portion 19 to the diameter D1. The diameter D2 at the narrowest portion of the necked down concave arcuate center portion 21 forms a single point that is generally about 75 to 84 percent of the diameter D1. The diameter D2 is generally disposed about midway between the trumpet portion 15 and the valve guide 5.

During engine operation thermal and mechanical loads cause the valve seat 3 and valve guide 5 in the head of the engine 1 to move out of alignment. Also, the valve seat itself becomes distorted and tipped. Necking down the stem 9 of the valve 7 adjacent the head portion 11 reduces the spring constant allowing the stem portion 9 to bend at the necked down portion 17, to accommodate the miss alignment and to seat properly without putting undo stress on the head portion 11. By reducing the stress on the head portion 11 and improving proper seating, valve life is extended. Lower stress on the head 11 increases the number of cycles to failure. Proper seating reduces the occurrence of flash heating or cooling of the valve head 11 due to exhaust gases or charge air rushing through a small gap between the valve seat ring 13 and the valve seat 3. Flash heating or cooling of the head 11 of the valve 7 caused uneven heating or cooling that results in inducing thermal stresses in the head 11 of the valve 7. Necking down the stem 9 increases the stress in the necked down area so that the amount the stem 9 is necked down is important. It has been determined that necking down the stem 9 generally between about 75 to 84 percent of its normal diameter will reduce the stress on the head portion 11 and improve seating without unduly increasing the stress in the necked down portion 17.

While the preferred embodiments described herein set forth the best mode to practice this invention presently contemplated by the inventor, numerous modifications and adaptations of this invention will be apparent to others of ordinary skill in the art. Therefore, the embodiments are to be considered as illustrative and exemplary and it is understood that the claims are intended to cover such modifications and adaptations as they are considered to be within the spirit and scope of this invention.

INDUSTRIAL APPLICABILITY

A valve for an internal combustion engine, when made in accordance with this invention, advantageously provides a reduction in the stress in the head of the valve and proper seating when the valve guide and seat become miss aligned during operation of the engine to increase the life of the valve.

What is claimed is:

1. A valve for an internal combustion engine having a head with a valve seat aligned with a valve guide, the valve comprising a head portion with a seat ring that seats in the valve seat in the head of the engine and a generally trumpet shaped portion which curves inwardly from the seat ring to a stem portion having a diameter that slidably fits in the valve guide, a portion of the stem between the valve guide and the trumpet shaped portion of the head is necked down to a single point disposed generally about midway between the trumpet shaped portion and the valve guide and having a diameter generally between about 75 to 84 percent of the diameter of the stem portion that slidably fits in the valve guide, whereby the spring constant of the necked down portion of the stem is reduced sufficiently to allow the valve stem to bend to accommodate misalignment of the valve guide and valve seat in the head of the engine due to thermal and mechanical loads resulting from operation of the engine and to seat properly and hermetically reducing stress in the valve head portion and not over stressing the necked down portion of the stem to prolong the life of the valve.

2. The valve as set forth in claim 1, wherein when the valve is seated the necked down portion is out side of the valve guide.

3. The valve as set forth in claim 1, wherein the necked down portion is generally hour glass shaped with an arcuate concave center potion and a arcuate convex portion on each end of the concave portion forming a smooth transition to the diameter that slidably fits into the valve guide.

* * * * *